US009038845B1

(12) United States Patent
Buck

(10) Patent No.: US 9,038,845 B1
(45) Date of Patent: May 26, 2015

(54) CONTAINER LID WITH ONE OR MORE CAVITIES

(71) Applicant: Ronald Mark Buck, Encinitas, CA (US)

(72) Inventor: Ronald Mark Buck, Encinitas, CA (US)

(73) Assignee: TOP-THAT! LLC, Encinitas, CA (US)

( * ) Notice: Subject to any disclaimer, the term of this patent is extended or adjusted under 35 U.S.C. 154(b) by 0 days.

(21) Appl. No.: 14/269,016

(22) Filed: May 2, 2014

(51) Int. Cl.
*B65D 51/28* (2006.01)
*A47G 19/22* (2006.01)

(52) U.S. Cl.
CPC ..... *B65D 51/28* (2013.01); *A47G 19/2272* (2013.01)

(58) Field of Classification Search
CPC ..... B65D 51/28; B65D 51/2807
USPC ..... 220/522, 521, 705, 708
See application file for complete search history.

(56) References Cited

U.S. PATENT DOCUMENTS

| | | | | |
|---|---|---|---|---|
| 34,976 | A | 4/1862 | Nicholson | |
| 36,131 | A | 8/1862 | Zettle | |
| 602,791 | A | 4/1898 | Wurzburg | |
| 674,305 | A | 5/1901 | Patterson | |
| 681,871 | A | 9/1901 | Burdick | |
| 726,321 | A | 4/1903 | Mason | |
| 730,903 | A | 6/1903 | Gibson | |
| 824,341 | A | 6/1906 | Cordes | |
| 873,867 | A | 12/1907 | Kirkgaard | |
| 930,938 | A * | 8/1909 | Clement | 220/521 |
| 1,002,963 | A | 9/1911 | Bostwick | |
| 1,331,336 | A | 2/1920 | Fisher | |
| 1,395,594 | A | 11/1921 | Pfefferle | |
| 1,434,831 | A | 11/1922 | Long | |
| 1,441,742 | A | 1/1923 | O'Brien | |
| 1,482,931 | A | 2/1924 | Keehn | |
| 1,485,136 | A | 2/1924 | House | |
| 1,545,227 | A | 7/1925 | Baltzley | |
| 1,600,758 | A | 9/1926 | Goldstein | |
| 1,609,453 | A | 12/1926 | Atwood | |
| 1,665,289 | A * | 4/1928 | Weaver | 229/400 |
| 1,713,676 | A | 5/1929 | Rose | |

(Continued)

FOREIGN PATENT DOCUMENTS

| | | |
|---|---|---|
| AU | 2009250333 | 5/2009 |
| AU | 2009250333 | 11/2009 |

(Continued)

OTHER PUBLICATIONS

U.S. Appl. No. 29/402,782, filed Sep. 27, 2011, Zomorodi.

(Continued)

*Primary Examiner* — Fenn Mathew
*Assistant Examiner* — Christopher McKinley
(74) *Attorney, Agent, or Firm* — Manuel de la Cerra

(57) ABSTRACT

A container lid with a first cavity is provided. The lid includes a continuous outer coupling trough for attachment of the lid to the open top of a container. The lid also includes a straw-hole planar surface with a hole for drinking a liquid in the container. A riser wall may extend away from the straw-hole planar surface and defines a first planar surface above the straw-hole planar surface. The first planar surface includes a the first cavity that has side walls connected to the first planar surface and extending from the first planar surface to a position lower than the first planar surface and a bottom connected to the side walls. A second planar surface is also disclosed that has a second cavity formed therein. The first cavity may be adapted to receive a condiment container and the second cavity to receive a food container.

14 Claims, 12 Drawing Sheets

(56) References Cited

U.S. PATENT DOCUMENTS 1,755,042 A 4/1930 Zoller
1,773,972 A 8/1930 Eberhart
1,862,620 A 6/1932 Graham
1,948,920 A 2/1934 Johnson
1,965,713 A 7/1934 Shaw
1,985,181 A 12/1934 Matthews
1,985,258 A 12/1934 Mauser
1,985,998 A 1/1935 Koch et al.
2,003,657 A 6/1935 Stabblefield
2,015,028 A 9/1935 Gillette
2,045,480 A 6/1936 Magnesen et al.
2,050,487 A 8/1936 Durrant
2,120,403 A 6/1938 Godfrey
2,121,843 A 6/1938 Vaughn
2,142,590 A 1/1939 Smith
2,148,468 A 2/1939 Hothersall
2,174,618 A 10/1939 Burdick
2,191,705 A 2/1940 Chamberlain
2,205,685 A 6/1940 Conner
2,241,044 A 5/1941 Knut
2,271,589 A 2/1942 Hendrickson
2,276,678 A 3/1942 Wheeler
2,327,077 A 8/1943 Teetor
2,328,543 A 9/1943 Bauman
2,339,343 A 1/1944 Magnesen
2,374,092 A 4/1945 Glaser
2,375,643 A 5/1945 Sermanotta
2,421,356 A 5/1947 Saffady
2,461,908 A 2/1949 Magnesen
2,484,039 A 10/1949 Krueger
2,545,979 A 3/1951 Tregear
2,649,984 A 8/1953 Abt
2,665,023 A 1/1954 Migneault
2,671,572 A 3/1954 Staz
2,748,976 A 6/1956 Magnesen
2,753,050 A 7/1956 Langston
2,760,674 A 8/1956 Karp
2,766,796 A 10/1956 Tupper
2,816,687 A 12/1957 Phillips
2,920,804 A 1/1960 Minton
2,965,496 A * 12/1960 Serdar ..... 426/120
2,977,019 A 3/1961 Henchert
2,982,440 A 5/1961 Harrison
3,045,859 A * 7/1962 McMahon ..... 220/521
3,045,887 A 7/1962 Caine
3,064,800 A 11/1962 Hart
3,070,275 A * 12/1962 Bostrom ..... 229/4.5
3,071,281 A 1/1963 Sawai
3,085,710 A 4/1963 McIlroy
3,138,432 A 6/1964 Kleinhans
RE25,618 E 7/1964 Goodman
3,157,335 A 11/1964 Maier
3,163,308 A 12/1964 Friedell
3,170,591 A 2/1965 Ullman et al.
3,185,341 A 5/1965 Barbour
3,187,919 A 6/1965 Inglis
3,194,468 A 7/1965 Baron
3,244,420 A 4/1966 Poynter
3,245,691 A 4/1966 Gorman
3,269,734 A 8/1966 Ottofy
3,285,462 A 11/1966 Bulmer et al.
3,288,344 A * 11/1966 Woollen et al. ..... 229/103.1
3,323,706 A * 6/1967 Gereke ..... 206/217
3,325,048 A 6/1967 Edwards
3,327,895 A 6/1967 Mueller
3,349,941 A 10/1967 Wanderer
3,369,687 A 2/1968 Walls
3,384,265 A 5/1968 Frank
3,397,867 A 8/1968 Hoff
3,401,825 A 9/1968 Weiss
3,413,128 A 11/1968 Steinbarth et al.
3,420,399 A 1/1969 Heisler
3,421,653 A 1/1969 Whaley
3,421,654 A 1/1969 Gunter
3,421,681 A 1/1969 Frank
3,425,580 A 2/1969 Brockhage
3,433,378 A 3/1969 Ross
3,439,841 A 4/1969 Irving
3,447,710 A 6/1969 Blair
3,456,860 A 7/1969 Janninck
3,495,733 A 2/1970 Davis
3,514,029 A * 5/1970 Powell ..... 206/223
3,515,306 A 6/1970 Roper et al.
3,532,244 A 10/1970 Yates, Jr.
3,557,995 A 1/1971 Mirasol, Jr. et al.
3,561,668 A 2/1971 Bergstrom
3,580,468 A 5/1971 McDevitt
3,598,271 A 8/1971 Holley
3,603,473 A 9/1971 Winberg
3,606,262 A 9/1971 Hoff
3,616,897 A 11/1971 Vrana
3,616,955 A 11/1971 Heffran
3,624,787 A 11/1971 Newman
3,674,512 A 7/1972 Andros
3,679,089 A 7/1972 Swett et al.
3,696,987 A 10/1972 Schuff
D226,063 S 1/1973 Warnberg
3,734,276 A 5/1973 Bank
3,743,520 A * 7/1973 Croner ..... 426/87
3,745,055 A 7/1973 Gorman
3,746,158 A 7/1973 Connick
3,765,559 A 10/1973 Sauey
3,768,688 A 10/1973 Linke
3,769,056 A 10/1973 Sincock
3,770,156 A 11/1973 Yates, Jr.
3,774,797 A 11/1973 Vliet
3,784,052 A 1/1974 Edwards
3,792,893 A 2/1974 Grotnes
3,796,813 A 3/1974 Kurland
3,797,696 A 3/1974 Dibrell
3,806,023 A 4/1974 Barnett
3,815,281 A 6/1974 Kander
3,817,419 A 6/1974 Moller et al.
3,820,684 A 6/1974 Harrison
3,822,030 A 7/1974 Tanzer
3,858,756 A 1/1975 Fulton
3,868,043 A 2/1975 Freemyer
3,874,554 A 4/1975 Chang
3,877,581 A 4/1975 Auxer
3,880,288 A 4/1975 Hunter
3,910,414 A 10/1975 McCay
3,942,679 A 3/1976 Starr
RE28,797 E 5/1976 Brewer
3,963,140 A 6/1976 Harding
3,974,931 A 8/1976 Moller
4,003,488 A 1/1977 Moller
4,007,936 A 2/1977 Hornsby, Jr.
4,009,805 A 3/1977 Klygis et al.
4,018,355 A 4/1977 Ando
4,027,779 A 6/1977 De Long
4,036,392 A * 7/1977 Martin ..... 220/521
4,049,122 A 9/1977 Maxwell
4,054,205 A 10/1977 Blow, Jr. et al.
4,056,210 A 11/1977 Boyle
4,074,827 A 2/1978 Labe, III
4,091,953 A 5/1978 Daenen
4,106,660 A 8/1978 Boyle
4,119,239 A 10/1978 Anderson
4,141,462 A 2/1979 Rucci
4,146,157 A 3/1979 Dixon et al.
4,183,444 A 1/1980 English
4,183,446 A 1/1980 Davis
4,186,842 A 2/1980 Albert
4,206,845 A 6/1980 Christian
4,234,100 A 11/1980 Chabot
4,264,007 A 4/1981 Hunt
4,279,353 A 7/1981 Honma
4,318,500 A 3/1982 Melikian
4,340,138 A 7/1982 Bernhardt
4,350,260 A 9/1982 Prueher
4,380,307 A 4/1983 Stillinger
4,389,802 A 6/1983 McLaren et al.
4,390,113 A 6/1983 Bird
4,407,426 A 10/1983 McLaren et al.

(56) References Cited

U.S. PATENT DOCUMENTS 4,423,822 A 1/1984 Powalowski
4,438,865 A 3/1984 Scattaregia
4,441,623 A 4/1984 Antoniak
4,446,969 A 5/1984 Tyler
4,458,584 A 7/1984 Annese et al.
4,478,346 A 10/1984 Spong
4,487,114 A 12/1984 Abdenour
4,489,848 A 12/1984 Braude
4,491,220 A 1/1985 Daviss
4,503,992 A 3/1985 Sitko et al.
4,518,096 A 5/1985 Winstead
4,564,116 A 1/1986 Prohaska
4,566,605 A * 1/1986 Rogers ..... 220/712
4,589,569 A 5/1986 Clements
D285,656 S 9/1986 Champion
4,619,372 A 10/1986 McFarland
4,625,890 A 12/1986 Galer
4,627,537 A 12/1986 Rogers
4,629,084 A 12/1986 Hackelsberger
D289,720 S 5/1987 Maher
D290,323 S 6/1987 Weernink
4,699,299 A 10/1987 Gach
4,717,037 A 1/1988 Van der Meulen
4,718,788 A 1/1988 Briscoe
4,728,003 A 3/1988 Davey
4,732,274 A 3/1988 Bouton
4,735,337 A 4/1988 Von Holdt
4,738,373 A 4/1988 DeParales
D296,874 S 7/1988 Dallas
D297,799 S 9/1988 Hammer
4,782,976 A 11/1988 Kenyon, II
4,785,931 A * 11/1988 Weir et al. ..... 206/222
4,789,076 A 12/1988 Jewitt et al.
4,795,052 A 1/1989 Hayes, Jr.
4,807,776 A 2/1989 Cortopassi
4,823,958 A 4/1989 Mahmud
D303,194 S 9/1989 Darby et al.
4,872,569 A 10/1989 Bolte
4,872,586 A 10/1989 Landis
4,877,151 A 10/1989 Rush et al.
4,901,881 A 2/1990 McElroy
4,906,158 A 3/1990 Dewitt et al.
4,938,373 A 7/1990 McKee
4,944,102 A 7/1990 Behlendorf et al.
4,966,294 A 10/1990 Mack
4,971,211 A 11/1990 Lake
D318,427 S 7/1991 Sherburne, Jr.
5,027,972 A * 7/1991 Bartholomew ..... 220/526
5,035,320 A 7/1991 Pione
5,046,632 A 9/1991 Bordner
5,052,553 A 10/1991 DeSanctis
5,054,642 A 10/1991 Yoshida
5,058,737 A 10/1991 Patterson et al.
5,060,820 A 10/1991 Boerner
5,064,082 A 11/1991 Lombardi et al.
D323,116 S 1/1992 Dart et al.
5,085,330 A 2/1992 Paulin
5,090,584 A 2/1992 Roberts et al.
D324,973 S 3/1992 Stagerman
5,099,232 A 3/1992 Howes
5,137,210 A 8/1992 Hibbs
5,145,646 A 9/1992 Tyranski
5,176,283 A 1/1993 Patterson et al.
5,180,079 A * 1/1993 Jeng ..... 220/705
D334,958 S 4/1993 Fischer
5,207,743 A 5/1993 Costarella et al.
5,234,125 A 8/1993 Roberts
5,240,136 A 8/1993 Patterson et al.
D339,027 S 9/1993 Mack
5,246,133 A 9/1993 James
5,249,700 A 10/1993 Dumke
5,283,140 A 2/1994 Netz et al.
5,292,028 A 3/1994 Patterson et al.
5,294,000 A 3/1994 Yanuzzi
5,310,072 A 5/1994 Matusovsky et al.
5,318,787 A 6/1994 Brauner
5,325,982 A 7/1994 Cobb, Jr.
5,346,070 A 9/1994 McSpadden
5,346,095 A 9/1994 Deal
5,366,089 A 11/1994 Parker
5,366,104 A 11/1994 Armstrong
5,375,828 A 12/1994 Shikami
5,377,860 A 1/1995 Littlejohn et al.
5,381,901 A 1/1995 Hundley
5,385,255 A 1/1995 Varano et al.
D355,735 S 2/1995 Shaffer et al.
5,388,729 A 2/1995 Gerringer
5,390,798 A 2/1995 Yanuzzi
5,392,949 A 2/1995 McKenna
5,393,258 A 2/1995 Karterman
5,397,023 A 3/1995 Toczek et al.
5,402,903 A 4/1995 Mann
D358,294 S 5/1995 Letica
5,415,312 A 5/1995 Mueller
5,417,364 A 5/1995 Shaw
5,429,262 A 7/1995 Sharkey
5,431,276 A 7/1995 Lialin
D361,469 S 8/1995 Young
5,441,164 A 8/1995 Beck et al.
5,449,089 A 9/1995 Turner
D362,801 S 10/1995 Milroy
5,464,150 A 11/1995 Porres Sanchez et al.
5,489,026 A 2/1996 D'Aloia
5,490,609 A 2/1996 Lane et al.
5,503,858 A 4/1996 Reskow
D370,412 S 6/1996 Rohrer
5,524,788 A 6/1996 Plester
5,524,817 A 6/1996 Meier et al.
5,529,179 A 6/1996 Hanson
5,531,347 A 7/1996 Goulding
5,538,154 A 7/1996 Von Holdt
5,540,333 A 7/1996 Gonzalez et al.
5,540,349 A 7/1996 Philips
D372,866 S 8/1996 Ahern, Jr.
5,542,532 A 8/1996 Mitchell
5,573,131 A * 11/1996 Berjis ..... 220/4.03
5,573,133 A 11/1996 Park
D376,311 S * 12/1996 Burton ..... D9/761
5,587,192 A 12/1996 Beizermann
5,592,766 A 1/1997 Mygatt
5,593,062 A 1/1997 Martin
5,624,053 A 4/1997 Freek et al.
5,641,063 A 6/1997 Gambardella et al.
5,647,499 A 7/1997 Piazza
D381,866 S 8/1997 St. Gelais
5,657,898 A 8/1997 Portman et al.
D383,944 S 9/1997 Lillelund
5,662,240 A 9/1997 Norris
D384,580 S 10/1997 Fernandes et al.
5,678,720 A 10/1997 Van Melle
5,685,449 A 11/1997 Oblak
5,695,052 A 12/1997 Damato
5,695,084 A 12/1997 Chmela et al.
5,697,509 A 12/1997 Hayes
5,699,927 A 12/1997 Lane et al.
5,705,210 A 1/1998 Sillince et al.
5,713,463 A 2/1998 Lakoski et al.
5,720,555 A 2/1998 Elele
5,722,558 A * 3/1998 Thompson ..... 220/521
5,725,117 A 3/1998 Berjis
5,725,122 A 3/1998 Murphy et al.
5,727,678 A 3/1998 Chen
D393,397 S 4/1998 Lillelund
5,743,423 A 4/1998 Franco
5,746,312 A * 5/1998 Johnson ..... 206/217
5,769,263 A 6/1998 Willingham et al.
5,775,570 A * 7/1998 Kim ..... 229/4.5
D397,911 S 9/1998 Waldmann
5,806,707 A 9/1998 Boehm et al.
5,829,583 A 11/1998 VerWeyst et al.
5,839,601 A 11/1998 Van Melle
5,875,957 A 3/1999 Yocum
5,894,952 A 4/1999 Mendenhall et al.
5,904,266 A 5/1999 Tedeschi

(56) References Cited

U.S. PATENT DOCUMENTS 5,911,331 A 6/1999 Boller
5,934,493 A 8/1999 Han
5,947,319 A 9/1999 Sinski
5,954,195 A 9/1999 Krueger et al.
5,971,195 A 10/1999 Reidinger et al.
5,979,647 A 11/1999 Han
5,984,131 A 11/1999 Krueger
5,992,061 A 11/1999 Fleck et al.
D417,845 S 12/1999 Sadlier et al.
5,996,832 A 12/1999 Nieuwoudt
6,003,671 A 12/1999 McDonough et al.
6,065,628 A 5/2000 Page
6,079,586 A 6/2000 Hanneman
6,079,587 A 6/2000 Vogt
6,085,919 A 7/2000 Singer
6,109,518 A 8/2000 Mueller et al.
6,112,891 A 9/2000 Wohl et al.
6,119,884 A 9/2000 Lowry
6,119,889 A 9/2000 Fujii et al.
6,119,930 A 9/2000 Lunstra et al.
6,164,485 A * 12/2000 Hilton ..... 220/521
6,176,390 B1 * 1/2001 Kemp ..... 220/712
6,202,542 B1 3/2001 Melton
6,209,234 B1 4/2001 Meyers
6,209,748 B1 4/2001 Dunbar
6,230,969 B1 5/2001 Spransy
6,263,923 B1 7/2001 Castillo
6,296,141 B1 10/2001 Lukacevic
6,299,014 B1 10/2001 Nava et al.
6,311,860 B1 * 11/2001 Reidinger et al. ..... 220/521
6,311,865 B1 11/2001 Laurent
6,314,866 B1 11/2001 Melton
D453,107 S 1/2002 Wyslotsky et al.
6,338,417 B1 * 1/2002 Ferraro ..... 220/23.83
6,354,190 B1 3/2002 Haydon
6,360,885 B1 3/2002 Krueger
6,364,102 B1 4/2002 Gordon et al.
6,375,023 B1 4/2002 Lecinski et al.
6,382,449 B1 5/2002 Kazmierski et al.
6,394,297 B1 5/2002 Nance
6,412,526 B2 7/2002 Castillo
6,425,480 B1 7/2002 Krueger et al.
6,427,864 B1 * 8/2002 Asselin ..... 220/709
6,464,099 B1 10/2002 Portman et al.
6,471,119 B2 10/2002 Cai
6,474,494 B1 * 11/2002 Miller ..... 220/379
6,488,173 B2 12/2002 Milan
6,528,105 B1 3/2003 Gerhart et al.
D473,463 S 4/2003 Armstrong
6,557,698 B2 5/2003 Gordon
6,641,854 B2 11/2003 Gerhart
6,648,164 B1 11/2003 DeCola et al.
6,652,435 B1 11/2003 Sand
6,679,397 B2 1/2004 Smith et al.
6,706,297 B1 * 3/2004 Toth et al. ..... 426/120
6,708,735 B1 * 3/2004 Kenihan ..... 141/18
6,726,946 B1 4/2004 Smith
6,766,902 B1 7/2004 Hartelius
6,793,075 B1 9/2004 Jeter
6,814,250 B1 * 11/2004 Madsen ..... 220/212
6,860,397 B1 3/2005 Walters, Jr.
6,915,901 B2 7/2005 Feinberg et al.
D508,819 S 8/2005 Mangla
6,932,231 B2 * 8/2005 Haynes et al. ..... 220/212
7,063,229 B2 * 6/2006 Westerhof et al. ..... 220/506
7,111,748 B2 * 9/2006 Cha ..... 220/4.27
7,159,732 B2 1/2007 Smith et al.
7,175,042 B2 2/2007 Durdon
7,182,242 B2 * 2/2007 Cai ..... 229/400
7,217,434 B1 * 5/2007 Loh et al. ..... 426/115
D559,035 S 1/2008 Hayes
7,341,754 B1 3/2008 Loh
7,387,063 B2 6/2008 Vu et al.
D590,662 S 4/2009 Cheng
7,568,586 B2 8/2009 Walters, Jr.
7,588,275 B2 9/2009 Borg
7,594,584 B2 9/2009 Durdon et al.
7,699,216 B2 4/2010 Smith et al.
7,721,911 B2 5/2010 Chou
D625,139 S 10/2010 Petlak
7,832,586 B2 11/2010 Vovan
7,866,502 B2 1/2011 Maxwell
D635,855 S 4/2011 Smith et al.
D637,079 S 5/2011 Brown et al.
7,942,260 B1 * 5/2011 Rodriguez ..... 206/217
D643,284 S 8/2011 Zomorodi
D643,285 S 8/2011 Zomorodi
D643,286 S 8/2011 Zomorodi
8,006,854 B2 8/2011 Waugh
D648,629 S 11/2011 Zomorodi
8,109,404 B2 2/2012 Chmela
8,141,727 B2 3/2012 Gruenwald et al.
8,317,024 B1 * 11/2012 Persi ..... 206/508
8,381,935 B1 * 2/2013 Buck ..... 220/254.4
8,448,801 B2 * 5/2013 Rusnak et al. ..... 220/23.86
8,590,730 B2 11/2013 Buck
8,596,491 B2 * 12/2013 Buck ..... 220/709
8,695,845 B2 4/2014 Buck
8,701,914 B1 4/2014 Buck
8,708,181 B2 4/2014 Buck
8,714,393 B2 5/2014 Buck
8,783,506 B2 * 7/2014 Lee ..... 220/705
8,800,801 B2 * 8/2014 Freeman ..... 220/521
2001/0035417 A1 11/2001 Kantor
2002/0037378 A1 3/2002 Littlejohn et al.
2002/0125262 A1 9/2002 Canfield
2002/0148833 A1 10/2002 Simon
2003/0024930 A1 2/2003 Smith et al.
2003/0089714 A1 5/2003 Dart et al.
2003/0102312 A1 6/2003 Horner
2003/0111468 A1 6/2003 Kao
2003/0178433 A1 9/2003 Adams
2004/0035867 A1 2/2004 Schultz et al.
2004/0050724 A1 3/2004 Grul et al.
2004/0050847 A1 * 3/2004 Yoon ..... 220/212
2004/0060934 A1 4/2004 Haynes et al.
2004/0084452 A1 5/2004 Hsieh
2004/0089662 A1 5/2004 Smith et al.
2004/0149755 A1 * 8/2004 Olivar ..... 220/212
2004/0182862 A1 * 9/2004 Scott ..... 220/212
2004/0262323 A1 * 12/2004 Cha ..... 220/709
2005/0035011 A1 2/2005 McRobbie
2005/0051549 A1 3/2005 Nelson
2005/0082305 A1 4/2005 Dais
2005/0103794 A1 5/2005 Liu
2005/0115845 A1 6/2005 Cho
2005/0178677 A1 8/2005 Morrow
2005/0178688 A1 8/2005 Hasson
2005/0199639 A1 9/2005 Tucker et al.
2005/0205437 A1 9/2005 Huffman et al.
2005/0269328 A1 12/2005 Crider et al.
2006/0000842 A1 1/2006 Maxwell
2006/0060589 A1 3/2006 Lee
2006/0091143 A1 5/2006 Chantalat
2006/0096983 A1 5/2006 Patterson
2006/0124648 A1 6/2006 Croft et al.
2006/0151414 A1 7/2006 Mullen
2007/0029322 A1 2/2007 Durdon et al.
2007/0068949 A1 3/2007 Crossley
2007/0181581 A1 8/2007 Ross
2007/0241105 A1 * 10/2007 Nielsen ..... 220/23.4
2007/0278122 A1 * 12/2007 McCumber et al. ..... 206/514
2008/0023503 A1 1/2008 Freeman
2008/0099481 A1 5/2008 D'Amato
2008/0230541 A1 9/2008 Bayss et al.
2008/0302802 A1 12/2008 Ramsden
2009/0065377 A1 3/2009 Olomi et al.
2009/0206089 A1 8/2009 Mueller
2009/0236305 A1 9/2009 Demarco et al.
2009/0250479 A1 10/2009 Kaufman et al.
2009/0272390 A1 11/2009 Blondeel
2009/0283526 A1 11/2009 Pierce et al.
2010/0038273 A1 2/2010 Johnson
2010/0108703 A1 5/2010 French

(56) References Cited

U.S. PATENT DOCUMENTS

| | | | | |
|---|---|---|---|---|
| 2010/0187247 | A1 | 7/2010 | Ziegler | |
| 2010/0320213 | A1 | 12/2010 | Kelly et al. | |
| 2011/0114643 | A1 | 5/2011 | Bogdziewicz | |
| 2011/0168719 | A1 | 7/2011 | Lotterhos | |
| 2011/0198351 | A1 | 8/2011 | D Amato | |
| 2011/0198355 | A1 | 8/2011 | Mullen | |
| 2011/0210126 | A1* | 9/2011 | Vovan | 220/574 |
| 2011/0248033 | A1 | 10/2011 | Mehrvijeh | |
| 2011/0266295 | A1 | 11/2011 | Yacktman | |
| 2011/0272656 | A1 | 11/2011 | Attwood | |
| 2011/0284537 | A1* | 11/2011 | Cerasani | 220/212 |
| 2011/0303678 | A1 | 12/2011 | Zomorodi | |
| 2011/0309093 | A1* | 12/2011 | Buck | 220/711 |
| 2012/0138608 | A1 | 6/2012 | Rusnak et al. | |
| 2012/0165170 | A1 | 6/2012 | Wischusen, III | |
| 2012/0187126 | A1 | 7/2012 | Shemesh | |
| 2012/0248116 | A1 | 10/2012 | Smyers et al. | |
| 2012/0273500 | A1* | 11/2012 | Yao | 220/521 |
| 2013/0068772 | A1* | 3/2013 | Durdon et al. | 220/521 |
| 2013/0068773 | A1 | 3/2013 | Buck | |
| 2013/0068774 | A1 | 3/2013 | Buck | |
| 2013/0119065 | A1* | 5/2013 | Buck | 220/523 |
| 2013/0228486 | A1 | 9/2013 | Buck | |
| 2014/0203025 | A1* | 7/2014 | Riggan et al. | 220/575 |

FOREIGN PATENT DOCUMENTS

| | | | |
|---|---|---|---|
| EP | 0064047 | A1 | 4/1982 |
| EP | 0162024 | A2 | 11/1985 |
| EP | 2205309 | | 12/1988 |
| EP | 0447693 | A1 | 9/1991 |
| EP | 1397986 | | 3/2004 |
| FR | 2649080 | | 6/1989 |
| FR | 2704209 | | 10/1994 |
| GB | 1060389 | | 3/1967 |
| GB | 2322289 | | 8/1998 |
| GB | 2375531 | | 11/2002 |
| JP | 04102557 | | 4/1992 |
| RU | 2118281 | | 8/1998 |
| WO | 2006029441 | | 3/2006 |
| WO | 2009140727 | | 11/2009 |
| WO | 2012033472 | | 3/2012 |

OTHER PUBLICATIONS

Internationa Search Report and Written Opinion issued in PCT/US2012/054032 on Mar. 19, 2013.

Internationa Search Report and Written Opinion issued in PCT/US2013/029188 on Jul. 11, 2013.

Internationa Search Report and Written Opinion issued in PCT/US2013/070630 on Mar. 13, 2014.

Internationa Search Report and Written Opinion issued in PCT/US2013/070632 on Mar. 13, 2014.

International Preliminary Report on Patentability issued in PCT/US2012/054032 on Mar. 20, 2014.

Prodekspo 2012: TM "Zelenaya Soya" razdelnaya upakovka dlya napitkov, Feb. 16, 2012, retrieved online on Jun. 11, 2013, retrieved from the internet http://news.unipak.ru38718comments.

* cited by examiner

FIGURE 3B
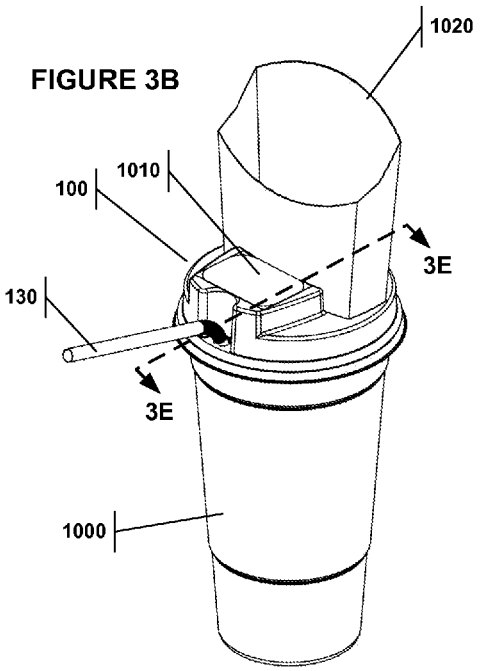
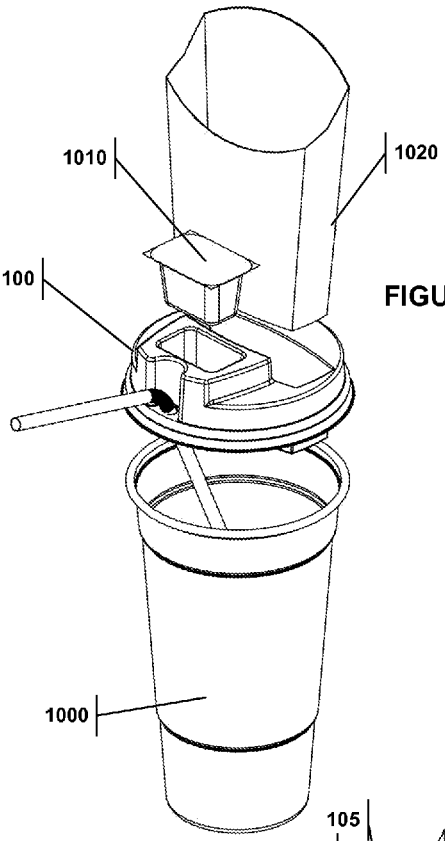
FIGURE 3C
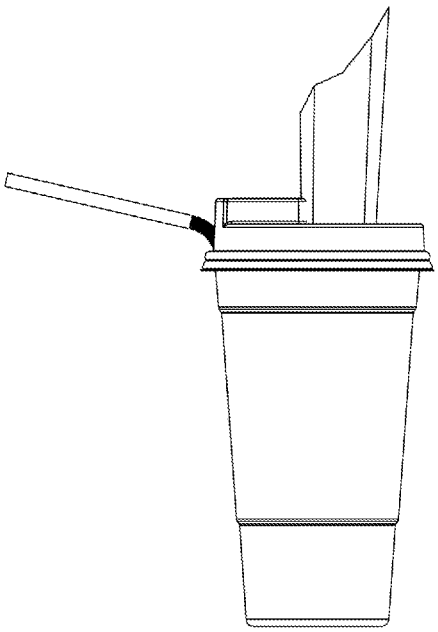
FIGURE 3D
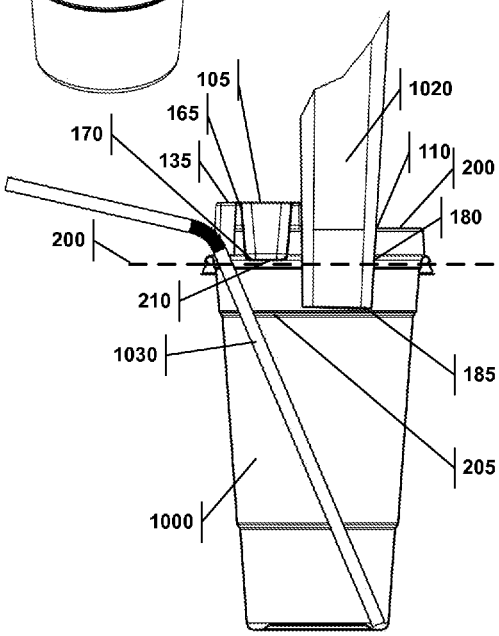
FIGURE 3E
(Line 3E-3E)

FIGURE 4B
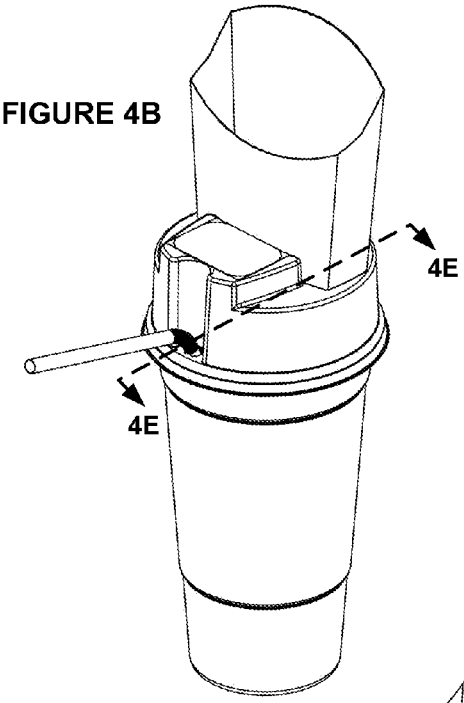
FIGURE 4C
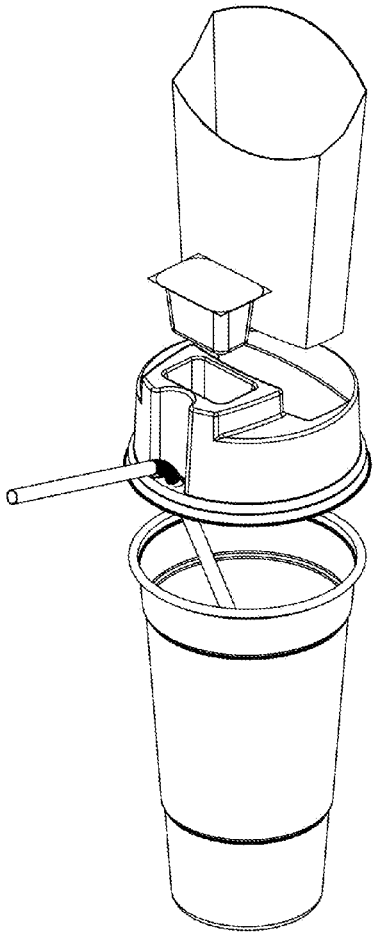
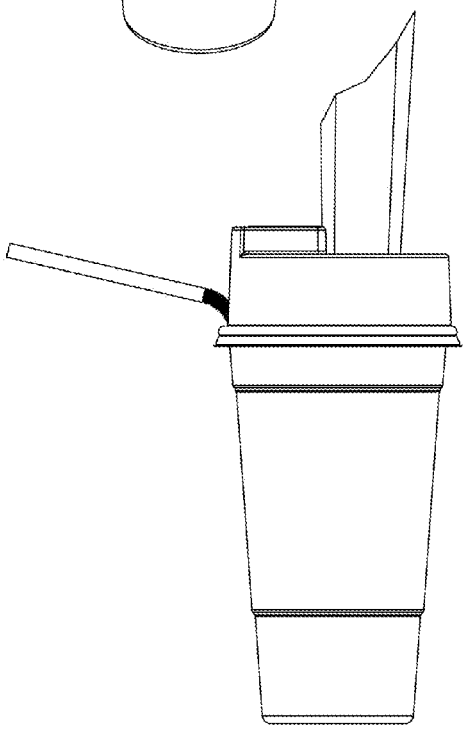
FIGURE 4D
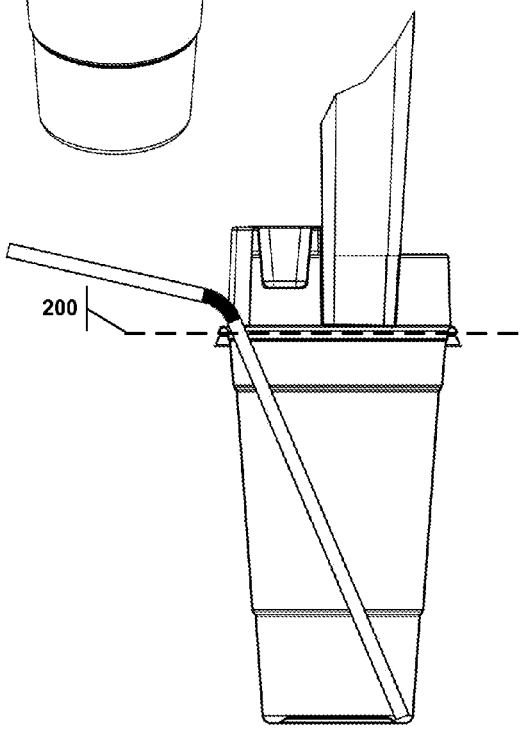
FIGURE 4E FIGURE 5B
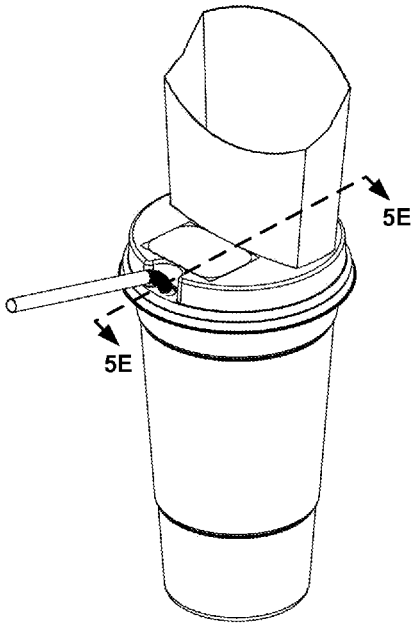
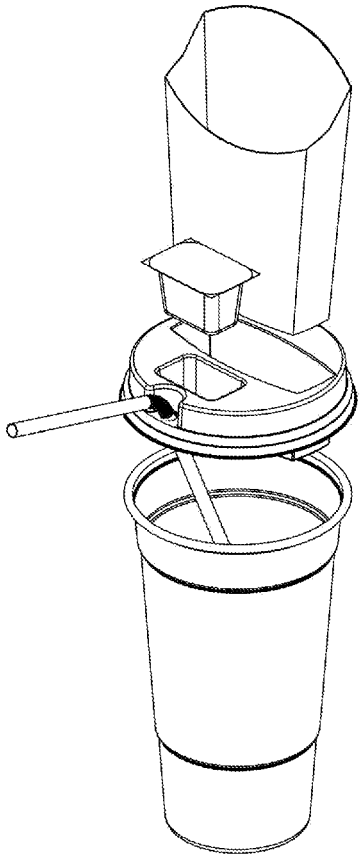
FIGURE 5C
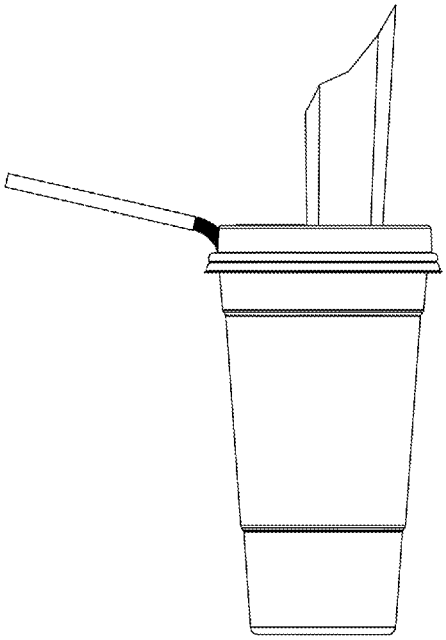
FIGURE 5D
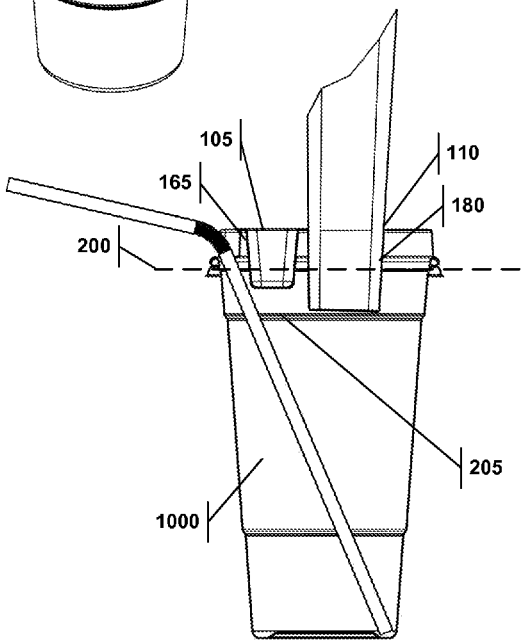
FIGURE 5E FIGURE 6B
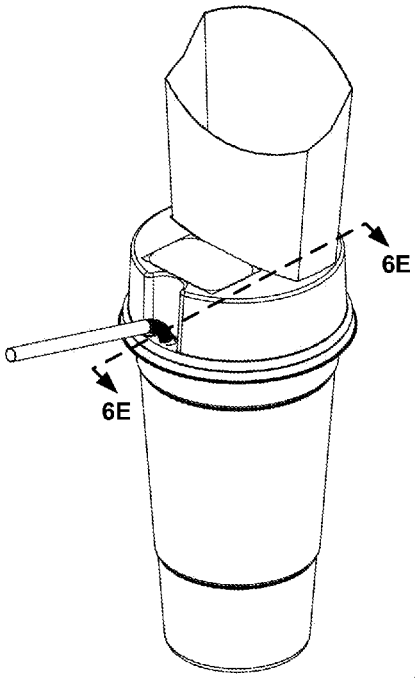
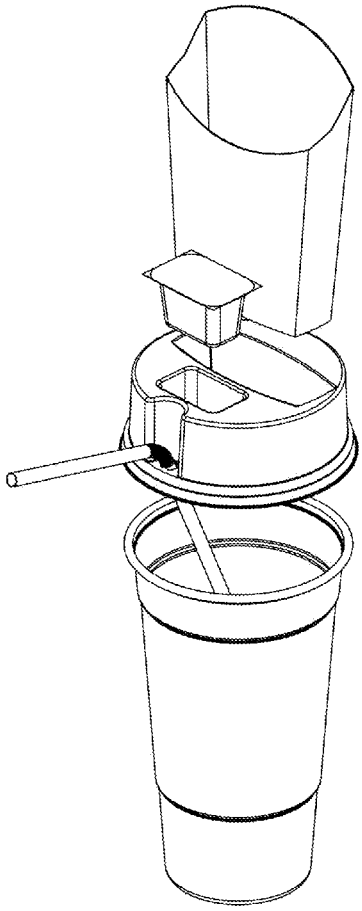
FIGURE 6C
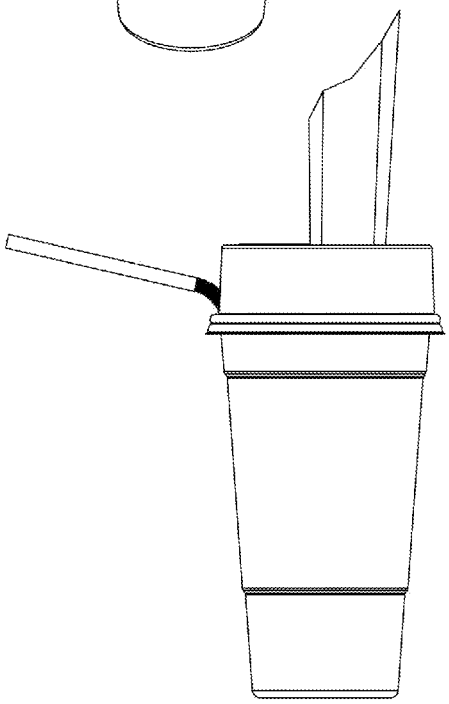
FIGURE 6D
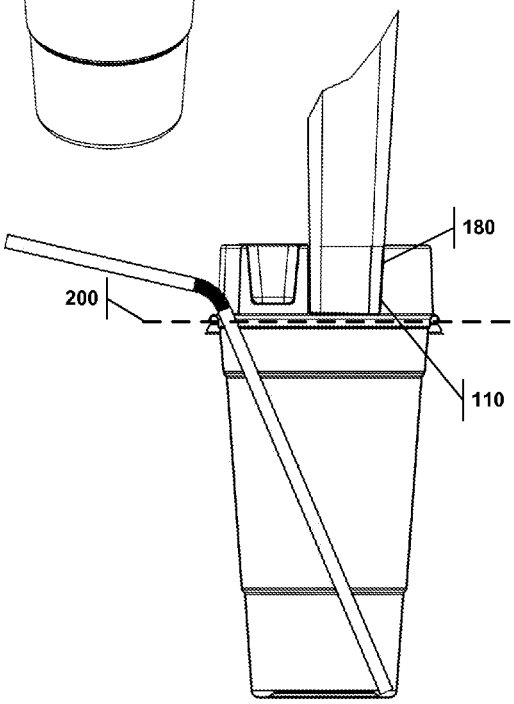
FIGURE 6E FIGURE 7B
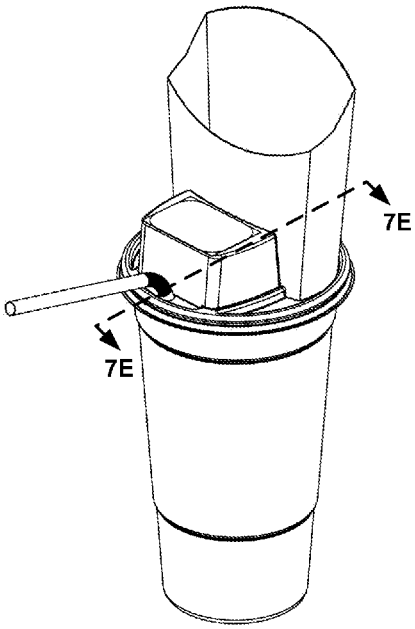
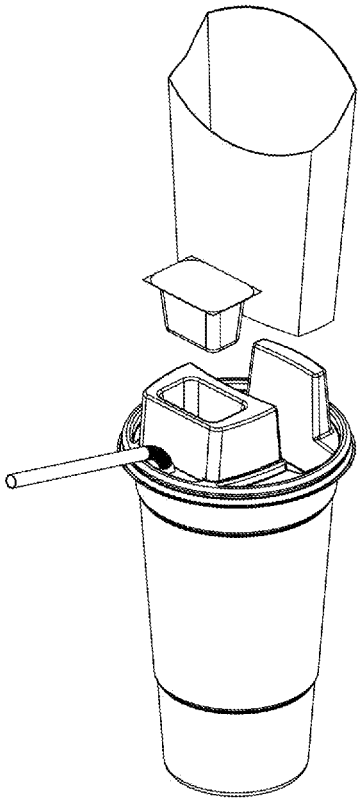
FIGURE 7C
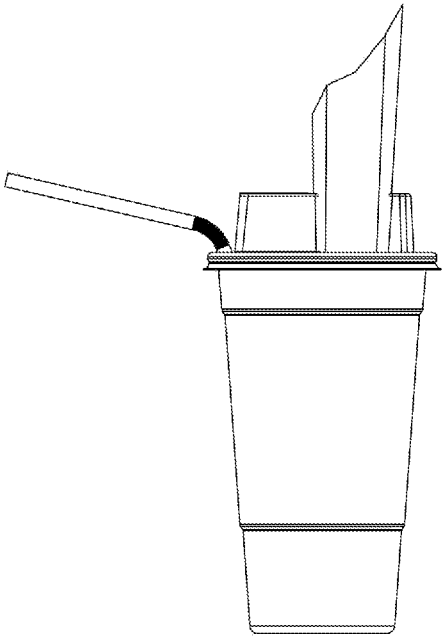
FIGURE 7D
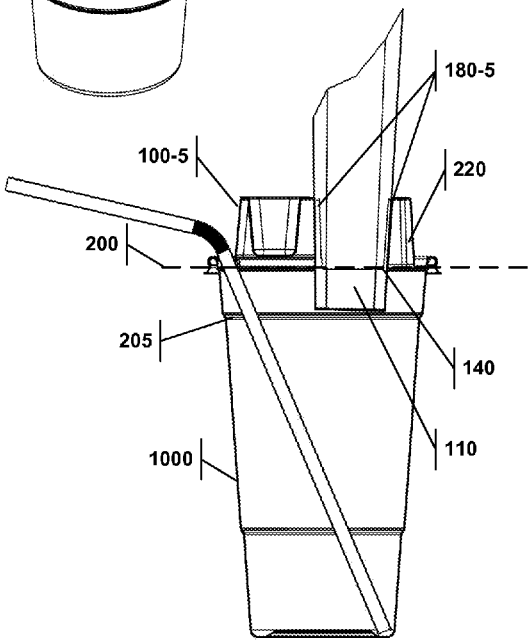
FIGURE 7E

CONTAINER LID WITH ONE OR MORE CAVITIES

1.0 TECHNICAL FIELD

The present invention relates to lids for disposable containers, and particularly to a new and novel lid with one or more cavities.

2.0 BACKGROUND

The increased popularity of fast food establishments, coupled with the popularity for consumption of food on-the-go has led to the need for more convenient carrying of condiments and food.

Billions of disposable beverage containers are used every year. Often those containers are part of a larger meal, and current technology dictates placing a lid on the beverage container, and packing the food and condiments in a separate and detached containers. This may be satisfactory for a consumer seated at a table. However, when the consumer must eat on-the-go, use of the current technology is problematic. Consider, for example, a consumer that is drinking the beverage and would like to access a French fry and ketchup. The consumer must set aside a beverage, and then use one hand to hold the bag and the other hand to access the ketchup packet, then set aside the bag and use both hands to open the packet, and finally free up one hand to access the fry and dip it into the packet. As shown in this example, current technology does not allow for convenient on-the-go eating.

Some prior art references have attempted to address these problems. For example, U.S. Pat. No. 5,722,558 discloses a container lid with a single reservoir that is configured to proceed downward from the top horizontal plane that is formed by the rim of the beverage container. The condiment reservoir projects downward into the floating ice or cold beverage that is contained within the beverage container such that the condiment within the downward reservoir becomes slightly chilled. The structure disclosed in U.S. Pat. No. 5,722,558 does not extend upwardly away from the plane defined by the rim. This has several shortcomings. First, since the disclosure only addresses a reservoir that extends downwardly into the beverage container, if the reservoir was to be substantially large or deep the liquid capacity of the beverage container would be adversely decreased because of fluid displacement. Second, the low position of the reservoir makes it difficult and messy to access. If, for example, a user were to fill the reservoir with ketchup, dipping into the reservoir would most likely cause the ketchup to spill onto the straw. Third, the low position of the reservoir interferes with the straw location and placement. For example as shown in FIG. 2A, when a straw is inserted it is likely that the bottom of the straw could not access the entire bottom surface of the beverage container. While this may be surmountable when the beverage is thin (like water), when the beverage is thick (like a milkshake) the user must be able to manipulate the straw along the entire bottom surface to extract all of the beverage. And again, as the size and/or depth of the reservoir increases, the more the reservoir will interfere with the straw location and placement.

U.S. Pat. No. 6,209,748 has some of the same shortcomings. In several embodiments, the outer ring that attaches to the beverage container rim has a perforated pour tab that can be lifted such that a user sip the beverage through the pour tab. This pour tab, however, substantially compromises the structural integrity of the lid rendering it structurally unable to support a large food container. In another embodiment, a pour hole is disclosed but that hole is at the same elevation as the reservoirs, again interfering with the straw location and placement.

What is therefore needed is a lid that overcomes these shortcomings, and fosters convenient on-the-go eating.

3.0 SUMMARY

The present invention provides an elegant solution to the needs described above and provides numerous additional benefits and advantages as will be apparent to persons of skill in the art. One aspect provides a container lid with a first cavity, the lid including a continuous outer coupling trough for attachment of the lid to the open top of a container where the trough circumscribes a footprint of the container lid. The lid also includes a straw-hole planar surface with a hole for drinking a liquid in the container. A riser wall may extend away from the straw-hole planar surface and defines a first planar surface above the straw-hole planar surface. The straw-hole surface and the first planar surface are within the footprint. The first planar surface includes a first opening that forms the first cavity, the first cavity further includes first cavity side walls connected to the first planar surface and extending from the first planar surface to a position lower than the first planar surface and a first cavity bottom connected to the first cavity side walls. The first planar surface may also have a second opening that forms a second cavity. The lid may also have a second planar surface that is above the straw-hole plane and below the first plane, and the second planar surface may have a second opening that forms a second cavity. The second planar surface may also be generally in the same plane as the outer coupling trough.

Another aspect provides a container lid with a first and second cavity, the lid includes a continuous outer coupling trough for attachment to the open top of a container where the trough circumscribes a footprint of the container lid. A hole extends through the lid for drinking a liquid in the container. A riser wall extends away from the outer coupling trough and defines a first planar surface above the outer coupling trough. The first planar surface is within the footprint and has a first opening that forms the first cavity. The first cavity further has first cavity side walls connected to the first planar surface and extending from the first planar surface to a position lower than the first planar surface and a first cavity bottom connected to the first cavity side walls. The first planar surface may also have a second opening that forms the second cavity, where the second cavity includes second cavity side walls connected to the first planar surface and extending from the first planar surface to a position lower than the first planar surface and a second cavity bottom connected to the second cavity side walls. The first cavity maybe located closer to the hole than the second cavity, and the first cavity is smaller than the second cavity.

Yet another aspect provides a container lid with a first and second cavity, the lid includes a continuous outer coupling trough for attachment to the open top of a container where the trough circumscribes a footprint of the container lid. A hole extends through the lid for drinking a liquid in the container. A riser wall extends away from the outer coupling trough and defines a first planar and a second planar surface above the outer coupling trough. The first planar surface is within the footprint and has a first opening that forms the first cavity. The first cavity further has first cavity side walls connected to the first planar surface and extending from the first planar surface to a position lower than the first planar surface and a first cavity bottom connected to the first cavity side walls. The second planar surface is within the footprint but below the first planar surface. The second planar surface has a second opening that forms the second cavity, where the second cavity includes second cavity side walls connected to the second planar surface and extending from the second planar surface to a position lower than the second planar surface and a second cavity bottom connected to the second cavity side walls. The first cavity maybe located closer to the hole than the second cavity, and the first cavity is smaller than the second cavity.

The riser wall may form an inward indent, and the first cavity maybe located closer to the hole than the second cavity. Also, the second cavity side walls maybe constructed to exert compressive force on a food container when the food container is disposed of in the second cavity. The first cavity may be adapted to receive a condiment container and the second cavity to receive a food container.

The foregoing summary is illustrative only and is not meant to be exhaustive. Other aspects, objects, and advantages of this invention will be apparent to those of skill in the art upon reviewing the drawings, the disclosure, and the appended claims.

4.0 BRIEF DESCRIPTION OF THE DRAWINGS

The invention can be better understood with reference to the following figures. The components within the figures are not necessarily to scale, emphasis instead being placed on clearly illustrating example aspects of the invention. In the figures, like reference numerals designate corresponding parts throughout the different views and/or embodiments. It will be understood that certain components and details may not appear in the figures to assist in more clearly describing the invention.

FIG. 3B is an isometric view of the first embodiment of the novel lid with two cavities of FIGS. 1 and 2A, attached to a beverage container.

FIG. 3C illustrates the first embodiment of the novel lid with two cavities of FIGS. 1 and 2A, in an exploded and isometric view with a beverage container.

FIG. 3D illustrates a side view of the first embodiment of the novel lid with two cavities of FIGS. 1 and 2A, attached to a beverage container.

FIG. 3E illustrates a cross-sectional view along line 3E-3E of the first embodiment of the novel lid with two cavities of FIGS. 1 and 2A, attached to a beverage container.

FIG. 4B is an isometric view of the second embodiment of the novel lid with two cavities of FIG. 2B, attached to a beverage container.

FIG. 4C illustrates the second embodiment of the novel lid with two cavities of FIG. 2B, in an exploded and isometric view with a beverage container.

FIG. 4D illustrates a side view of the second embodiment of the novel lid with two cavities of FIG. 2B, attached to a beverage container.

FIG. 4E illustrates a cross-sectional view along line 4E-4E of the second embodiment of the novel lid with two cavities of FIG. 2B, attached to a beverage container.

FIG. 5B is an isometric view of the third embodiment of the novel lid with two cavities of FIG. 2C, attached to a beverage container.

FIG. 5C illustrates the third embodiment of the novel lid with two cavities of FIG. 2C, in an exploded and isometric view with a beverage container.

FIG. 5D illustrates a side view of the third embodiment of the novel lid with two cavities of FIG. 2C, attached to a beverage container.

FIG. 5E illustrates a cross-sectional view along line 5E-5E of the third embodiment of the novel lid with two cavities of FIG. 2C, attached to a beverage container.

FIG. 6B is an isometric view of the fourth embodiment of the novel lid with two cavities of FIG. 2D, attached to a beverage container.

FIG. 6C illustrates the fourth embodiment of the novel lid with two cavities of FIG. 2D, in an exploded and isometric view with a beverage container.

FIG. 6D illustrates a side view of the fourth embodiment of the novel lid with two cavities of FIG. 2D, attached to a beverage container.

FIG. 6E illustrates a cross-sectional view along line 6E-6E of the fourth embodiment of the novel lid with two cavities of FIG. 2D, attached to a beverage container.

FIG. 7B is an isometric view of the fifth embodiment of the novel lid with two cavities of FIG. 2E, attached to a beverage container.

FIG. 7C illustrates the fifth embodiment of the novel lid with two cavities of FIG. 2E, in an exploded and isometric view with a beverage container.

FIG. 7D illustrates a side view of the fifth embodiment of the novel lid with two cavities of FIG. 2E, attached to a beverage container.

FIG. 7E illustrates a cross-sectional view along line 7E-7E of the fifth embodiment of the novel lid with two cavities of FIG. 2E, attached to a beverage container.

5.0 DETAILED DESCRIPTION OF EXAMPLE EMBODIMENTS

Following is a non-limiting written description of example embodiments illustrating various aspects of the invention. These examples are provided to enable a person of ordinary skill in the art to practice the full scope of the invention without having to engage in an undue amount of experimentation. As will be apparent to persons skilled in the art, further modifications and adaptations can be made without departing from the spirit and scope of the invention, which is limited only by the claims.

In the following description, numerous specific details are set forth in order to provide a thorough understanding of the present invention. Particular example embodiments of the present invention may be implemented without some or all of these features or specific details. In other instances, components well known to persons of skill in the art have not been described in detail in order not to obscure unnecessarily the present invention.

Figure 1:
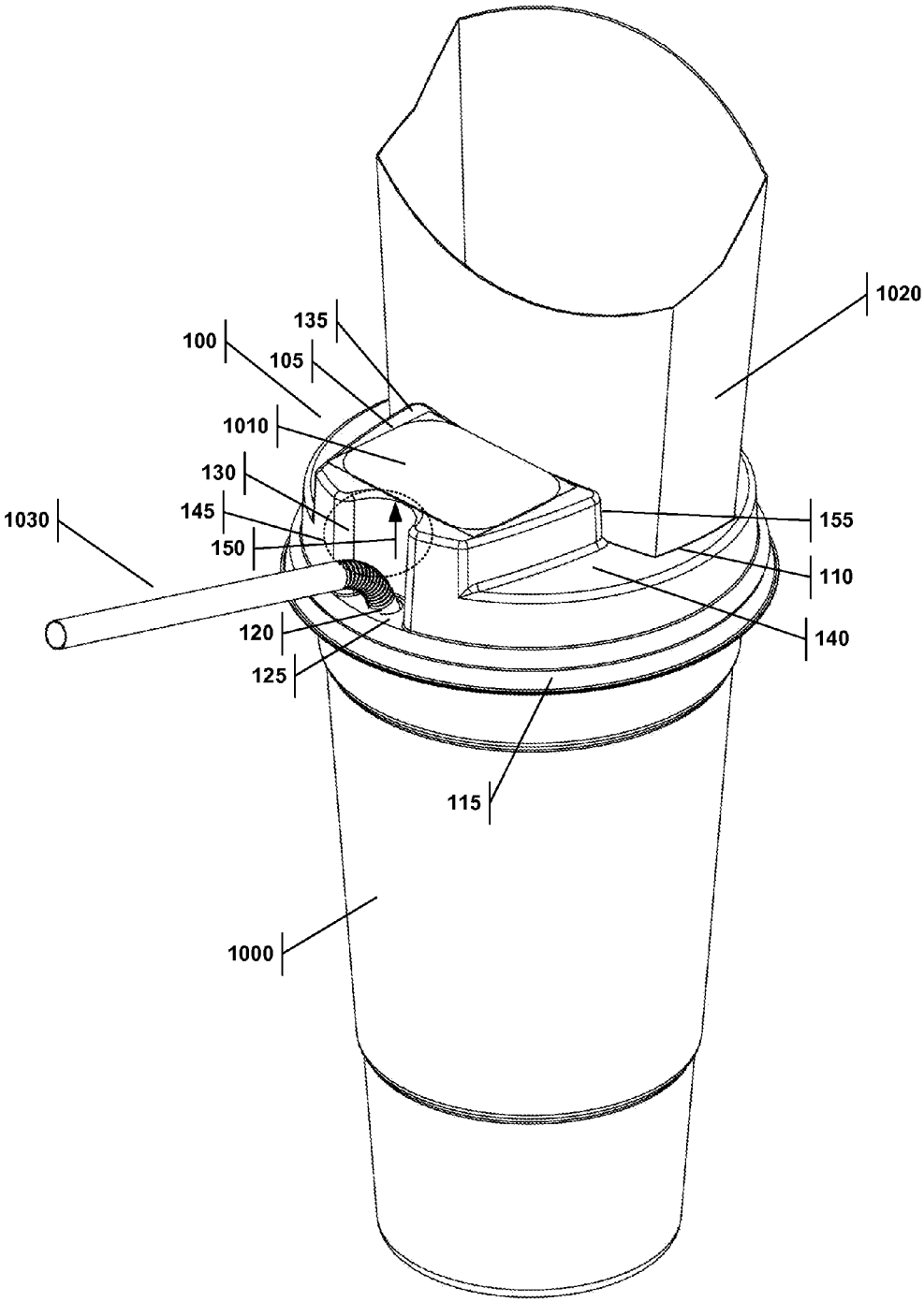
FIG. 1 is an isometric view of a first embodiment of a novel lid with two cavities attached to a beverage container.

Referring to FIG. 1, a lid 100 is shown connected to a beverage container 1000. The lid 100 contains a first cavity 105 intended to hold a condiment container 1010 and a second cavity 110 intended to hold a food container 1020. Optionally, the first cavity 105 may hold the condiment directly without the use of a condiment container. Similarly, the second cavity 110 may hold the food directly without the use of a food container.

The lid 100 may be removable attached to the beverage container 1000 by an outer coupling trough 115 that mates with and locks onto the lip of the beverage container 1000. The outer coupling trough 115 continuously circumscribes the lid 100 and defines a footprint of the lid 100. What is meant by a footprint is essentially the area the lid 100 would project onto a horizontal surface when the lid 100 is placed on a horizontal surface. The continuous outer coupling trough 115 adds structural integrity to the lid 100 such that the lid 100 resists undue deformation that would render it difficult to properly install onto the lip of the beverage container 1000. Additionally, the outer coupling trough 115 provides a liquid-proof seal so as to prevent spillage.

The lid 100 also has a straw hole 120 that allows a straw 1030 to access the liquid held by the beverage container 1000. The straw hole 120 is located on the straw-hole planar surface 125 that may be substantially parallel to the plane defined by the outer coupling trough 115 (i.e., would be substantially horizontal). The straw-hole planar surface 125 may connect to the outer coupling trough 115.

Riser wall 130 may extend away from the straw-hole planar surface 125 and also away from the outer coupling trough 115. It would be apparent to one of skill in the art that the riser wall 130 may be a single uninterrupted wall or a series of walls. The top of the riser wall 130 defines a first planar surface 135 that is above the straw-hole planar surface 125. Throughout this disclosure the terms "above" and "below" will be used, and are intended to mean the following: "above" is a location that is vertically higher when the lid 100 is attached to a beverage container 1000 resting on a horizontal surface; and "below" is a location that is vertically lower when the lid 100 is attached to a beverage container 1000 resting on a horizontal surface. The first cavity 105 is formed into the first planar surface 135.

The top of the riser wall 130 may also define a second planar surface 140 that is above the straw-hole planar surface 125, but below the first planar surface 135. The second cavity 110 is formed into the second planar surface 140.

The riser wall 130 may also have an inward indent 145, shown in an arched shape. It would be apparent to those of skill in the art that the inward indent 145 may be of any suitable shape. In the embodiment shown in FIG. 1, the inward indent 145 allows room for the straw-hole planar surface 125, while allowing the riser wall 130 to continuously follow the outer edge of the lid 100. And because the riser wall 130 follows the outer edge, it provides more structurally stability to the lid 100. This stability is necessary given the torsional forces imparted onto the lid by the food container's 1020 high center of gravity.

Not only does the placement of the inward indent 130 provide room for the straw-hold planar surface 125 and the straw 1030 when inserted, but it also provides the user of the lid 100 an easy way to remove a condiment container 1010. Specifically, condiment containers 1010 often have an outer flange for structural reinforcement, and that flange may hang over the inward indent 130 such that the user can manipulate their finger in the direction of arrow 150, thus lifting the condiment container 1010 out of the first cavity 105.

The relative elevations and locations of the straw-hole planar surface 125, the first planar surface 135 and the second planar surface 140 address several issues. Because the height of the first planar surface 135 is higher than the second planar surface 140, the opening of the condiment container 1010 placed in the first cavity 105 would be closer to the opening of the food container 1020, allowing a user to more easily access the condiment without a mess. Also elevating the first cavity 105 prevents the bottom of the first cavity 170 from interfering with the straw (this is shown in FIG. 3E); thus allowing a user unfettered access (via the straw) to the entire bottom of the beverage container 1000. The lower elevation of the straw-hole planar surface 125 lowers the location of the straw such that the condiment is less likely to be spilt onto the straw, causing a mess for the user. Also, the elevated first planar surface 135 provides a longer vertical side wall 155 for the second cavity 110, which further stabilized the food container 1020 which has a high center of gravity. Finally, the first cavity 105 is located closer to the straw hole 120, than the second cavity 110. A user can thus hold the beverage container 1000 with one hand and take a drink from the straw 1030, then with his other hand grab a French fry from the food container 1020, dip it in the ketchup from the condiment container 1010 and continuing in the same motion bringing the dipped French fry to their mouth. It should be apparent that the container lids described herein may be used for a variety of food items, such as by non-limiting example, chicken strips, chick nuggets, potato wedges, and fish sticks.

Figure 2A:
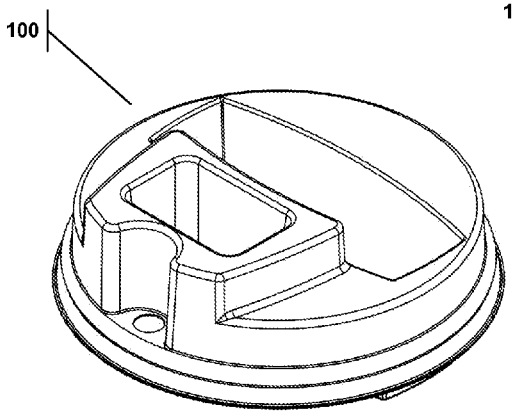
FIG. 2A is an isometric view of the first embodiment of the novel lid with two cavities of FIG. 1, wherein the lid is not attached to a beverage container.
Figure 2B:
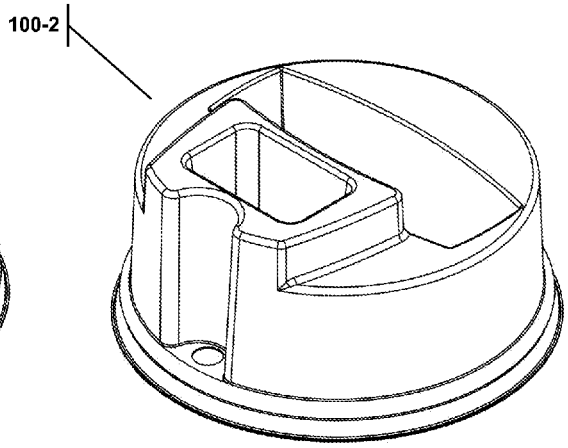
FIG. 2B is an isometric view of a second embodiment of a novel lid with two cavities, wherein the lid is not attached to a beverage container.
Figure 2C:
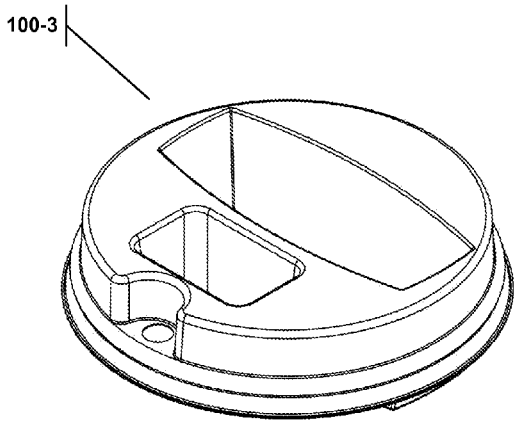
FIG. 2C is an isometric view of a third embodiment of a novel lid with two cavities, wherein the lid is not attached to a beverage container.
Figure 2D:
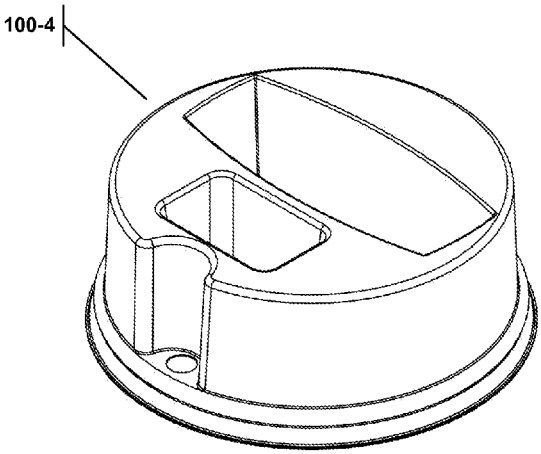
FIG. 2D is an isometric view of a fourth embodiment of a novel lid with two cavities, wherein the lid is not attached to a beverage container.
Figure 2E:
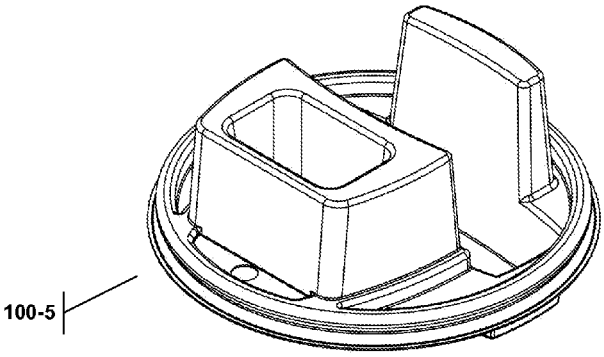
FIG. 2E is an isometric view of a fifth embodiment of a novel lid with two cavities, wherein the lid is not attached to a beverage container.
Figure 3A:
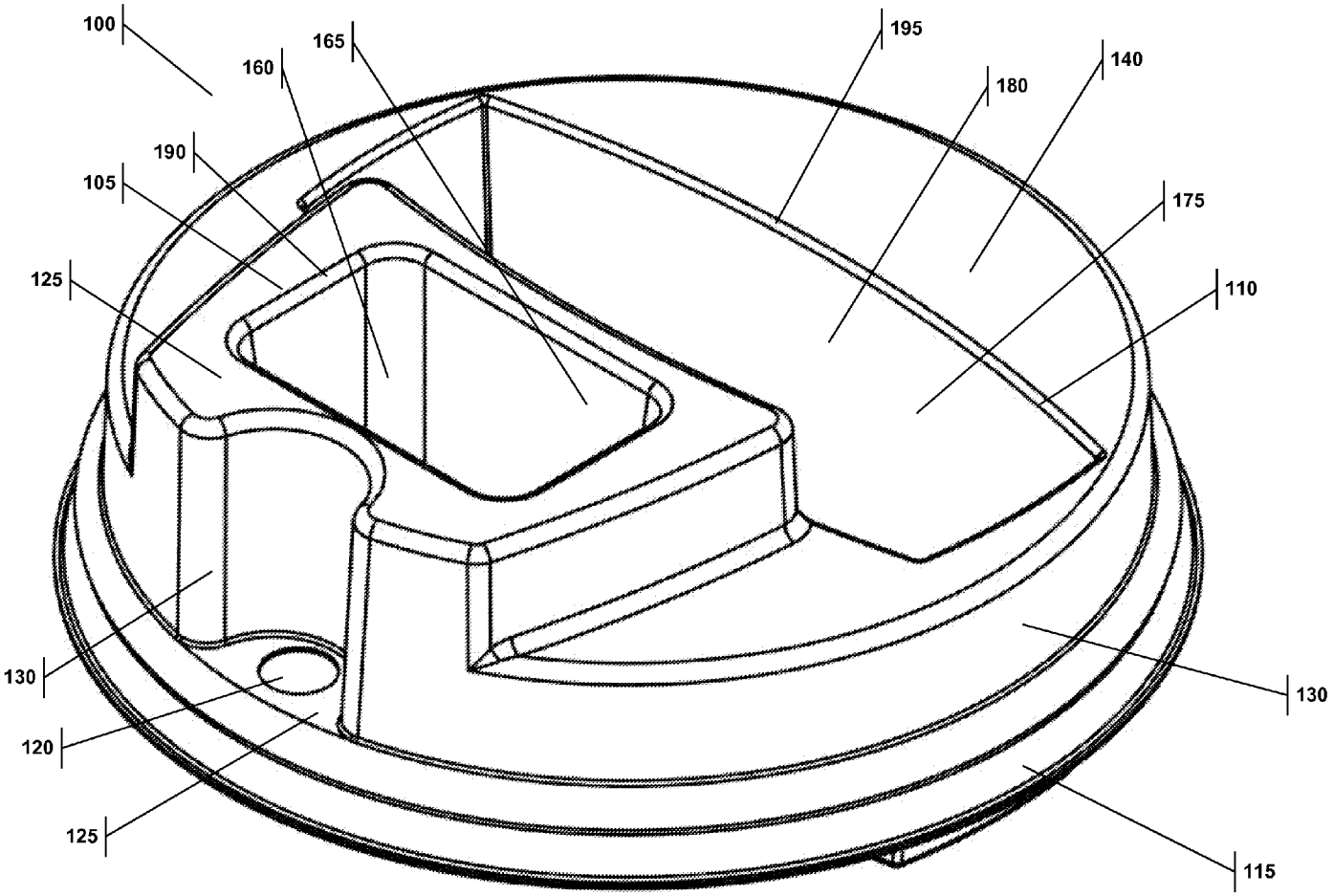
FIG. 3A is an isometric view of the first embodiment of the novel lid with two cavities of FIGS. 1 and 2A.
Figure 4A:
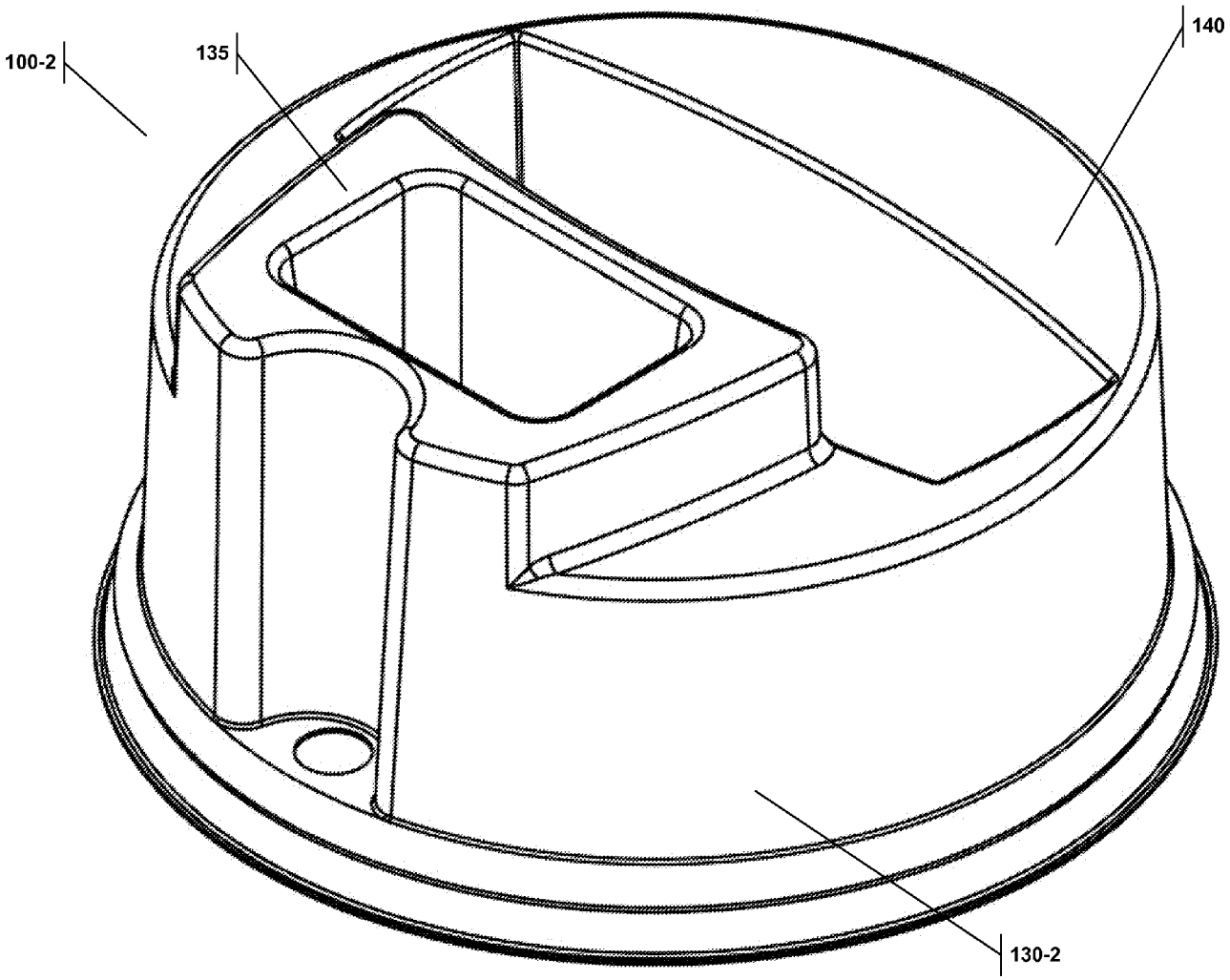
FIG. 4A is an isometric view of the second embodiment of the novel lid with two cavities of FIG. 2B.
Figure 5A:
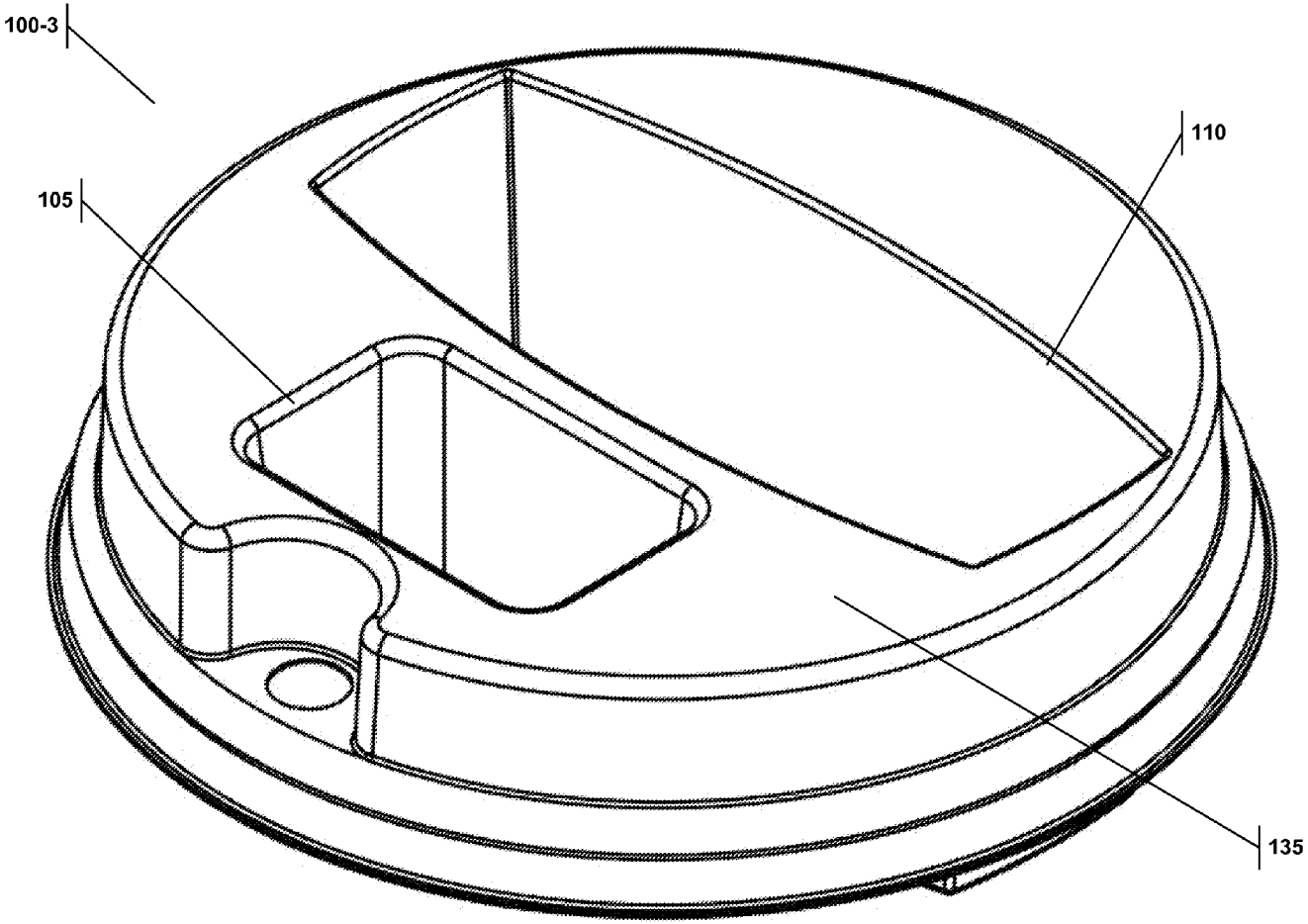
FIG. 5A is an isometric view of the third embodiment of the novel lid with two cavities of FIG. 2C.
Figure 6A:
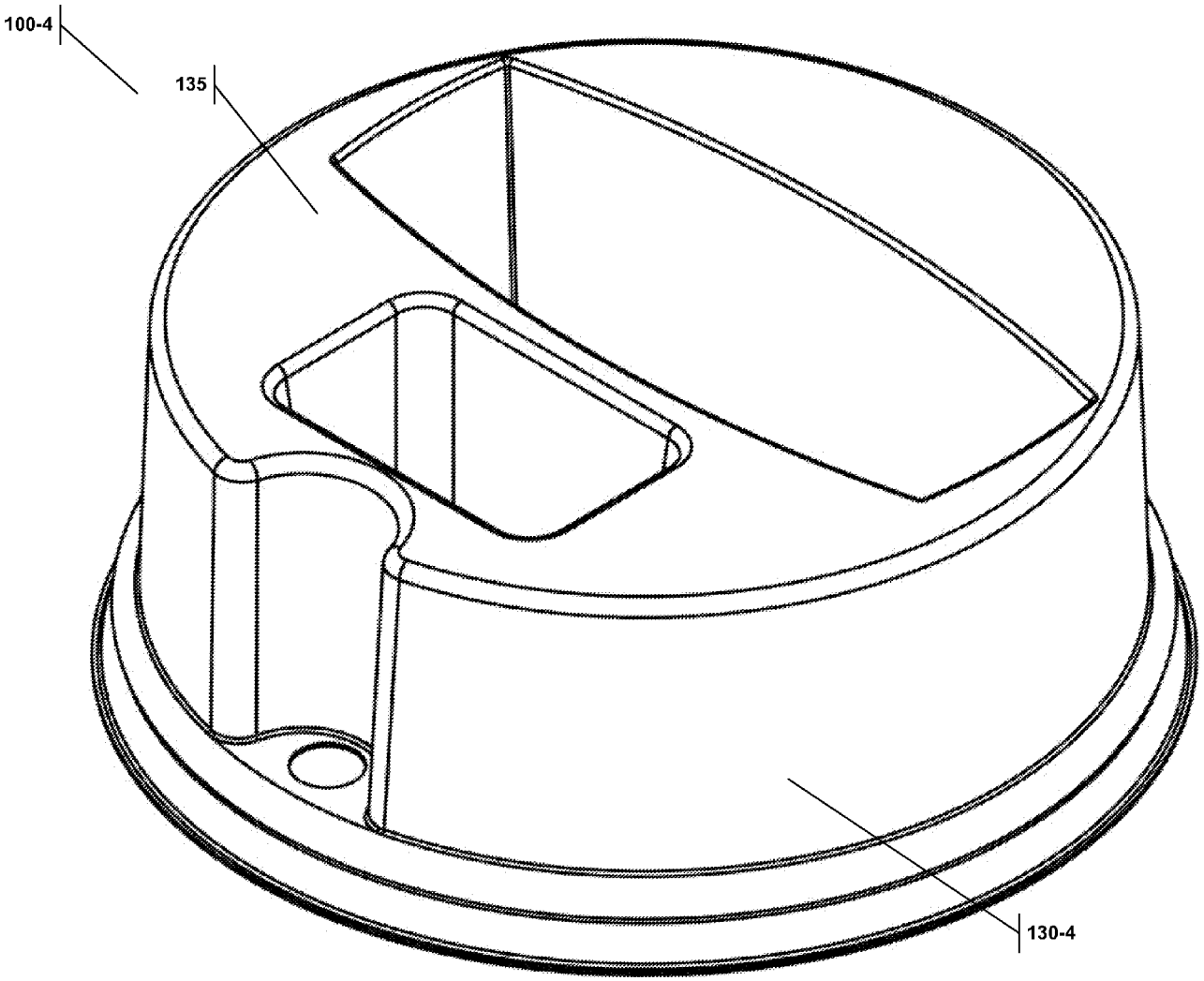
FIG. 6A is an isometric view of the fourth embodiment of the novel lid with two cavities of FIG. 2D.
Figure 7A:
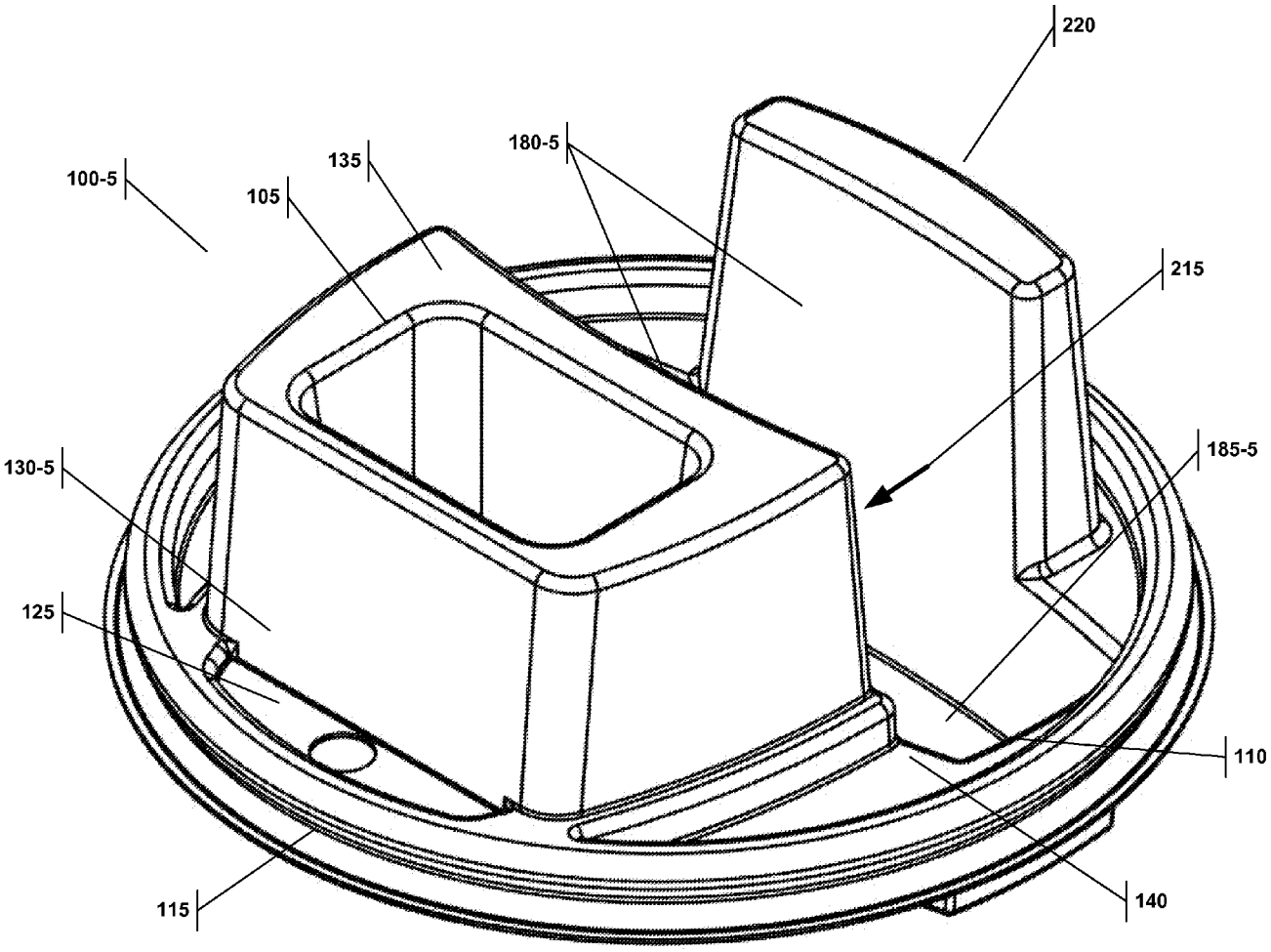
FIG. 7A is an isometric view of the fifth embodiment of the novel lid with two cavities of FIG. 2E.

FIG. 2A illustrates the lid 100 of the embodiment just describe with reference to FIG. 1, while FIGS. 2B through 2E illustrate other embodiments. Each of these embodiments will be discussed in detail below as follows:

FIGS. 3A through 3E detail the lid 100 shown in FIG. 2A
FIGS. 4A through 4E detail the lid 100-2 shown in FIG. 2B
FIGS. 5A through 5E detail the lid 100-3 shown in FIG. 2C
FIGS. 6A through 6E detail the lid 100-4 shown in FIG. 2D
FIGS. 7A through 7E detail the lid 100-5 shown in FIG. 2E Turning now to FIGS. 3A through 3E, a lid 100 is shown which is the same embodiment just described with reference to FIG. 1. FIG. 3A shows just the lid 100 without the straw, the food container, the condiment container, or the beverage container. The lid 100 may be removable attached to a beverage container by an outer coupling trough 115 that mates with and locks onto the lip of the beverage container. The lid 100 also has a straw hole 120 located on the straw-hole planar surface 125 that may be substantially parallel to the plane defined by the outer coupling trough 115. The straw-hole planar surface may connect to the outer coupling trough 115.

The first cavity 105 has a first opening 160 in the first planar surface 125. Riser wall 130 which extends away from the straw-hole planar surface 125 supports the first planar surface 125. Extending downwardly away from the first planar surface 125 are first cavity side walls 165 and a first cavity bottom 170 (FIG. 3E); the side walls 165 and the bottom 170 form the first cavity 105.

The second cavity 110 has a second opening 175 in the second planar surface 140. Riser wall 130 supports the second planar surface 140. Extending downwardly away from the second planar surface 140 are second cavity side walls 180 and a second cavity bottom 185 (FIG. 3E); the side walls 180 and the bottom 185 form the second cavity 110. The riser wall has an arch-shaped inward indent 145.

The first cavity side walls 165 may be constructed to exert compressive force on the condiment container when the condiment container is placed in the first cavity 105. This may be done, for example, by making first cavity side walls 165 taper to a width that is narrower that the condiment container. Because the first cavity side walls 165 are constructed of a semi-compliant material, the first cavity side walls 165 would slightly flex when the condiment container is inserted and that flexing would cause the first cavity side walls 165 to exert compressive force on the condiment container. The second cavity side walls 180 may be constructed in the same fashion. This compressive force stabilizes the condiment container and food container, thus preventing spilling.

The edge of the first cavity 105 may be beveled 190, to allow for the easier insertion of the condiment container. Likewise the edge of the second cavity 110 may also be beveled 195, to allow for the easier insertion of the food container.

FIG. 3B illustrates the lid 100 attached to the beverage container 1000, with a straw 1030, condiment container 1010 and food container 1020 inserted into the lid 100. FIG. 3C shows an exploded view of the lid 100, with the straw 1030 inserted, but the lid 100 is not attached to the beverage container 1000, and the condiment container 1010 and food container 1020 are not inserted. FIG. 3D is a side view.

FIG. 3E is a cut away cross section take along the line 3E-3E of the FIG. 3B. This view illustrates how the first cavity side walls 165 extend downwardly away from the first planar surface 135, with a first cavity bottom 170 forming the bottom of the first cavity 105. Similarly, the second cavity side walls 180 extend downwardly away from the second planar surface 140, with a second cavity bottom 185 forming the bottom of the second cavity 110. This view also shows how the elevation of the first cavity 105 and the first cavity bottom 170, provide a clear path through which a user can insert the straw 1030 and access the entire bottom surface of the beverage container. Further, the lower elevation of the second cavity 110 lowers the center-of gravity of the relatively tall food container 1020, adding stability.

FIG. 3E also illustrates that the second cavity side walls 180 extend downwardly past the outer coupling trough 115. Stated another way, the outer coupling trough 115 defines a plane 200 and the second cavity sidewalls 180 extend downwardly to an elevation lower than the plane 200.

It should be noted that because the second cavity side walls 180 extend downwardly past the outer coupling trough 115, the second cavity 110 displaces some of the volume of the beverage container 1000. If the beverage container 1000 is filled to the brim, then attaching the lid 100 to the beverage container 1000 would cause the liquid to spill. To prevent this, it may be advantageous to include a fill line indicator 205 such that when the liquid is filled below the fill line indicator 205 the lid 100 will not displace the liquid and will not cause a spill. This may be a line printed on the beverage container 1000 or a structure, such as a ring or a step.

To prevent the transfer of heat between the beverage and the food in the food compartment, the underside of the lid may include an insulation layer 210, or alternatively, the insulation layer may float on the top of the beverage contained in the beverage container 1000.

Turning now to FIGS. 4A through 4E, a second embodiment is shown. This lid 100-2 is substantially similar to the first embodiment (i.e., lid 100) described with reference to FIGS. 1, and 3A through 3E. The difference is that the riser wall 130-2 is taller, thus elevating the first planar surface 135 and the second planar surface 140. This is shown in more detail in FIG. 4E, which is a cut away cross-section take along the line 4E-4E of the FIG. 4B. The second cavity side walls do not extend downwardly past the plane 200 defined by the outer coupling trough. Because the second cavity side walls do not extend past the plane 200, the second cavity will not displace the volume of the beverage container 1000, and no fill line indicator would be needed.

FIGS. 5A through 5E illustrate a third embodiment. This lid 100-3 does not have a second planar surface as did the embodiments (i.e., lid 100 and lid 100-2) described with reference to FIGS. 1, 3A through 3E, and 4A through 4E. Rather, both the first cavity 105 and the second cavity 110 are formed into the first planar surface 135, and the first planar surface is at an elevation that is lower than in previous embodiments. This is shown in more detail in FIG. 5E, which is a cut away cross-section take along the line 5E-5E of the FIG. 5B. Both the first cavity side walls 165 and the second cavity side walls 180 extend downwardly past the plane 200 defined by the outer coupling trough. Thus both the first cavity 105 and the second cavity 110 displace some of the volume of the beverage container 1000. A fill line indicator 205 on the beverage container 1000 would be preferable when using the lid 100-3.

FIGS. 6A through 6E detail a fourth embodiment. This lid 100-4 is substantially similar to the third embodiment (i.e., lid 100-3) described with reference to FIGS. 5A through 5E. The difference is that the riser wall 130-4 is taller, thus elevating the first planar surface 135. This is shown in more detail in FIG. 6E, which is a cut away cross-section take along the line 6E-6E of the FIG. 6B. The second cavity side walls 180 do not extend downwardly past the plane 200 defined by the outer coupling trough. Because the second cavity side walls do not extend past the plane 200, the second cavity 110 will not displace the volume of the beverage container 1000, and no fill line indicator would be needed.

FIGS. 7A through 7E detail the fifth embodiment. The lid 100-5 includes a first cavity 105, a second cavity 110, a straw-hole planar surface 125 and an outer coupling trough 115. Riser wall 130-5 extends from the straw-hole planar surface 125 and defines a first planar surface 135, into which the first cavity 105 is disposed. The outer coupling trough 115 defines a plane 200 (FIG. 7E), and a second planar surface 140 is generally within the plane 200. The second planar surface 140 is connected to the outer coupling trough 115 on its outer edge. It is within this second planar surface 140 that the second cavity 110 is disposed.

The riser wall 130-5 forms part of the second cavity side walls 180-5 (shown at position 215), which adds stability to the food container because the second cavity bottom 185-5 is not as deep into the second cavity 110. Without the riser wall 130-5, the food container would rock and potentially dislodge from the second cavity 110.

To further stabilize the food container, the lid 100-5 may include a stability structure 220 that allows a portion of the second cavity side walls 180-5 to extend above the second planar surface 140. FIG. 7E illustrates how a portion of the second cavity side walls 180-5 extend above the second planar surface 140.

It should also be noted that a portion of the second cavity side walls 180-5 also extend downwardly past the plane 200 defined by the outer coupling trough; thus the second cavity 110 displaces some of the volume of the beverage container 1000. To prevent spillage, a fill line indicator 205 on the beverage container 1000 would be preferable when using the lid 100-5.

The embodiments described herein can be constructed using a variety of methods, including by non-limiting example thermoformed (thin gauge) and thin wall injection molding. The types of material would be apparent to one of skill in the art and may include by non-limiting example PP (polypropylene), PET (polyethylene terephthalate), CPET, RPET Polyethylene (HDPE/LDPE), styrene, HIPS, HMWPE, PP/PE blends, custom blends of thermoplastics (which may or may not include post-consumer or post-industrial content) and other proprietary blends of thermoplastics.

The invention has been described in connection with specific embodiments that illustrate examples of the invention but do not limit its scope. Various example systems have been shown and described having various aspects and elements. Unless indicated otherwise, any feature, aspect or element of any of these systems may be removed from, added to, combined with or modified by any other feature, aspect or element of any of the systems. As will be apparent to persons skilled in the art, modifications and adaptations to the above-described systems and methods can be made without departing from the spirit and scope of the invention, which is defined only by the following claims. Moreover, the applicant expressly does not intend that the following claims "and the embodiments in the specification to be strictly coextensive." *Phillips* v. *AHW Corp.,* 415 F.3d 1303, 1323 (Fed. Cir. 2005) (en banc).

The invention claimed is:

1. A container lid with a first cavity and a second cavity, comprising:

an outer coupling trough for attachment to the open top of a container, the trough circumscribing a footprint of the container lid;

a straw-hole planar surface within the footprint, the straw-hole planar surface adjacent the outer coupling trough and comprising a straw hole for drinking a liquid from the container;

a riser wall extending upward from the straw-hole planar surface, the riser wall defining a first planar surface above the straw-hole planar surface, the first planar surface within the footprint; and the first cavity formed in the first planar surface, the first cavity comprising first cavity side walls extending downward from the first planar surface by a first distance to a first cavity bottom connected to the first cavity side walls;

the second cavity formed in a second planar surface that is within the footprint and parallel to the first planar surface, the second cavity comprising second cavity side walls adapted to closely surround the perimeter of a lower portion of a food container having a high center of gravity and a width at least substantially as wide as the width of the footprint, the second cavity sidewalls extending downward from the second planar surface by a second distance a second cavity bottom;

wherein the second cavity is adapted to stabilize and support in use said food container, when the container lid is attached to the open top of a container and the perimeter of the lower portion of said food container is closely surrounded by the second cavity side walls while a portion of said food container extends above the second planar surface;

wherein the first cavity sidewalls and the second cavity sidewalls are constructed to prevent the spilling of the contents in the first cavity into the second cavity.

2. The lid of claim 1, wherein the riser wall forms an inward indent adapted to provide clearance for a straw to be placed through the straw hole.

3. The lid of claim 1, wherein the riser wall also extends upward from the outer coupling trough.

4. The lid of claim 1, wherein the outer coupling trough defines a plane and the first cavity side walls extend through the plane.

5. The lid of claim 1, wherein the second planar surface is located vertically between the first planar surface and the straw-hole planar surface.

6. The lid of claim 1, wherein the second planar surface is coplanar with the first planar surface.

7. The lid of claim 1, wherein the first cavity is located closer to the straw hole than the second cavity.

8. The lid of claim 1, wherein the second cavity side walls are constructed to exert compressive force on a food container when the food container is disposed of in the second cavity.

9. The lid of claim 1, wherein the second cavity extends from a first edge of the footprint of the container lid to an opposite edge of the footprint of the container lid.

10. The lid of claim 1, wherein the first cavity side walls are constructed to exert compressive force on a conventional condiment packet when the conventional condiment packet is disposed of in the first cavity.

11. The lid of claim 1, wherein the outer coupling trough defines a plane and the second cavity side walls extend through the plane.

12. The lid of claim 1, further comprising a stability structure comprising at least a portion of the second cavity side walls extending above the second planar surface.

13. The lid of claim 1, wherein the second distance is greater than the first distance.

14. The lid of claim 1, wherein the first cavity comprises a first opening and the second cavity comprises a second opening, wherein the first opening is smaller than the second opening.

* * * * *